United States Patent [19]

Smith et al.

[11] Patent Number: 4,462,751

[45] Date of Patent: Jul. 31, 1984

[54] CENTRIFUGAL PUMP IMPROVEMENT

[75] Inventors: Wallace L. Smith, Fallbrook; Randal S. Ferman, Monterey Park, both of Calif.

[73] Assignee: Borg-Warner Corporation, Chicago, Ill.

[21] Appl. No.: 361,232

[22] Filed: Mar. 24, 1982

[51] Int. Cl.[3] ..... F01D 29/44

[52] U.S. Cl. ..... 415/89; 415/183; 415/207; 415/210; 415/219 C; 415/DIG. 5

[58] Field of Search ..... 415/209, 210, 217, 73, 415/71, 89, 142, 183, 204, 207, 216, 219 C, DIG. 5

[56] References Cited

U.S. PATENT DOCUMENTS

| | | | |
|---|---|---|---|
| 1,150,747 | 8/1915 | Delery | 415/209 |
| 1,530,326 | 3/1925 | Prindle . | |
| 1,976,200 | 10/1934 | Swanson . | |
| 2,483,335 | 9/1949 | Davis | 415/210 |
| 2,596,646 | 5/1952 | Buchi | 415/210 |
| 2,609,141 | 9/1952 | Aue | 415/210 |
| 3,333,762 | 8/1967 | Vrana | 415/209 |
| 4,063,849 | 12/1977 | Modianos | 415/210 |

*Primary Examiner*—John W. Shepperd
*Assistant Examiner*—B. J. Bowman
*Attorney, Agent, or Firm*—Aubrey L. Burgess

[57] ABSTRACT

A centrifugal pump assembly comprising one or more bowl castings each housing an impeller and also two or more individual fluid passageways for the flow of fluid discharged by an impeller to the next impeller, the passageways having some exterior walls defining the exterior of the assembly. By changing the number of the individual passageways, the specific speed of the pump, i.e., the ratio of the amount of energy imparted to the fluid and the amount of fluid being pumped, can be changed.

3 Claims, 5 Drawing Figures

PRIOR ART

CENTRIFUGAL PUMP IMPROVEMENT

BACKGROUND OF THE INVENTION

This invention relates to centrifugal pumps in which fluid is led to the "eye" or center of an impeller through an inlet, and the pressure is produced as the fluid is rotated by the impeller at high speed. Higher fluid pressure can be obtained when the high speed fluid is slowed to a lesser velocity.

The total pressure of a particle of fluid is made up of its static pressure, which is what is measured on a pressure gauge, and its dynamic pressure, which depends on the speed at which it is moving. The dynamic pressure is the pressure exerted on an object suddenly introduced in front of the moving particle. The dynamic pressure increases as the square of the velocity. It is not possible to convert all the dynamic pressure in a flowing fluid to static pressure, but it is possible to recover about 50 to 80 percent of the dynamic pressure. One method of recovering some of the dynamic pressure is to slowly increase the delivery channel area, as for example with a diverging taper of about 8°. This recovery can be accomplished in a diffuser, i.e., fluid passages which carry fluid from an impeller to the inlet of another impeller or to a pump discharge. Most pumps of any size have some type of diffuser. In many of the so-called centrifugal pumps, there are a plurality of pump stages, i.e., a plurality of impellers, each discharging into a diffuser, and to a final discharge.

The usual vertical diffuser pump assembly comprises a plurality of interconnected castings, for example, an intake casting, one or more bowl castings, and a discharge head. A centrifugal impeller is associated with each bowl casting and each impeller is driven by a common shaft connected to an electric motor or other prime mover. The bowl casting includes an acorn, i.e., the inner structural core of the pump in the form of a conical-shaped part which defines the inner profile of the diffuser passageways and which surrounds the shaft and retains a shaft sleeve bearing. An annular wall of the acorn defines a portion of an impeller chamber with another portion of the impeller chamber being defined by the next preceeding casting, whether it be a bowl casting or intake casting. In addition to the acorn portion, the bowl casting comprises an outer, generally circular by cylindrical wall joined to the conical wall of the acorn by a plurality of connecting and generally radially oriented walls or vanes, thus forming a plurality of fluid passageways for the flow of fluid from the impeller. The radially oriented walls or vanes terminate short of the ends of the bowl castings to thus define generally annular chambers for receiving and discharging fluid to and from the passageways, respectively. In the usual pump described, each of the fluid passageways has a cross-sectional area which increases from inlet to outlet, i.e., in the direction of the fluid flow.

SUMMARY OF THE INVENTION

In accordance with the invention herein to be described, a vertical radial diffuser pump comprises essentially the same general components and arrangement of prior art pumps of the same type, i.e., a pump assembly constructed of an intake casting, one or more bowl castings and a discharge casting. A centrifugal impeller is associated with each bowl casting. The impeller is driven by a shaft connected to an electric motor or other prime mover. A major difference between a pump constructed according to this invention and prior art pumps is a modified bowl casting. The modified bowl casting of this invention results in certain advantages which will be described hereinafter.

The modified bowl casting of this invention comprises an acorn portion, similar to configuration and function to the prior art acorn previously described. However, unlike the previously described bowl casting, each fluid passageway is individually defined by surrounding walls, some of which extend radially from the acorn portion, such that portions of the acorn actually define parts of the exterior walls of the bowl casting. In the prior art acorn configurations, the acorn is completely surrounded by the exterior wall of the bowl casting. The individual passageways or volutes of the bowl casting of this invention are generally spaced from each other and can be generally spirally configured. The individual passageways join spaced, annular regions, one communicating with the impeller chamber and the other communicating either with the discharge casting or a succeeding impeller chamber, as the case may be.

A higher ratio of radial to axial displacement of fluid in an impeller produces a greater pressure for a given capacity. A radial diffuser shape following the impeller allows the maximum amount of kinetic energy to be changed to static energy before it is lost in a bend or turn while being directed back to the next stage impeller or to discharge.

The invention herein described relates to a single suction vertical pump assembly that permits radial diffusers (fluid expansion and velocity-to-pressure conversion passageways extending in a fully tangential and radial direction, not axial, outward from the impeller) which is lighter in weight than conventional pumps. This is accomplished by individually enclosing each fluid passage in the crossover region with an individual covering or wall which is integrally cast on to the acorn.

The passages are not constrained to follow a hydraulic path dictated by an outer circular shaped boundary. By eliminating outer circular boundary design constraint, the fluid passages can be shaped to suit an optimum crossover to the next stage or discharge. Also, because the effective pressure boundary size is reduced, wall thicknesses, and thus weight, are reduced. Two or more diffuser-crossovers are used. Using this invention, the pump specific speed, i.e., a dimensionless ratio between the amount of energy imparted to a fluid and the amount of fluid being pumped, can be altered by simply changing the number of individual crossover passageways on the bowl casting. Considering the specific speed of a pump to achieve high pressures, the specific speed will be relatively low and to achieve high volumes of pumped fluid, the specific speed will be relatively high. Thus the flow characteristic of the bowl casting of this invention can be effectively changed by changing the number of crossover passageways while retaining the basic mechanical form and the basic passageways hydraulic shape.

DETAILED DESCRIPTION OF THE PREFERRED EMBODIMENT

Figure 1:
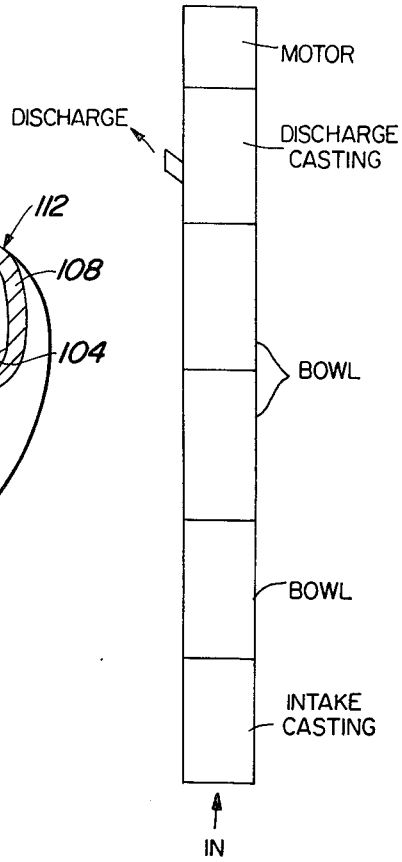
FIG. 1 is a schematic illustration of a typical vertical pump.

FIG. 1 of the drawings illustrates schematically the general arrangement of vertical diffuser pumps which comprise, from bottom to top, an intake casting, one or more bowl castings, a discharge casting and a motor. Details of prior art pumps and the pump of this invention will be described with specific reference to FIGS. 2 and 3, and FIGS. 4 and 5, respectively, of the drawings.

Figure 3:
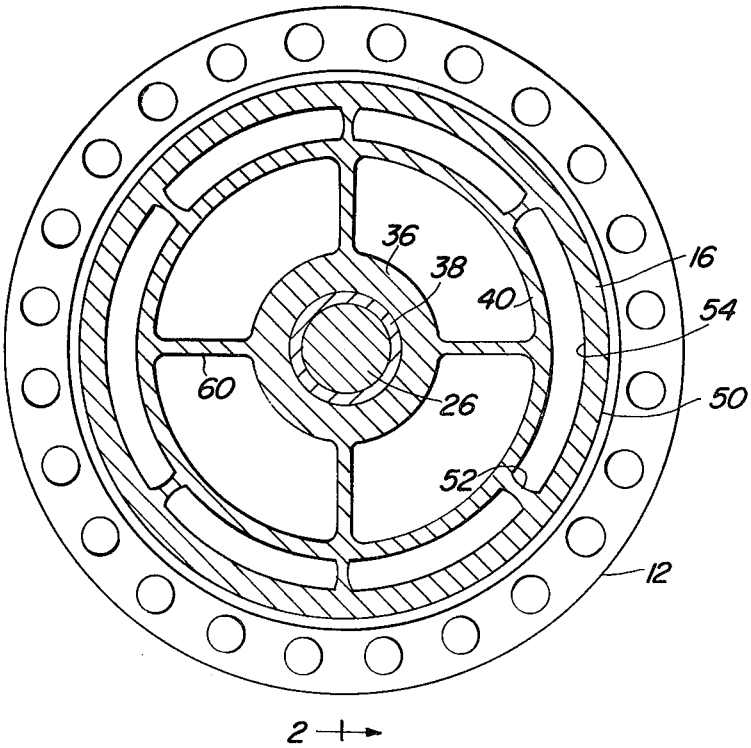
FIG. 3 is a sectional view taken on line 3—3 of FIG. 2 and is also labeled "PRIOR ART"
Figure 2:
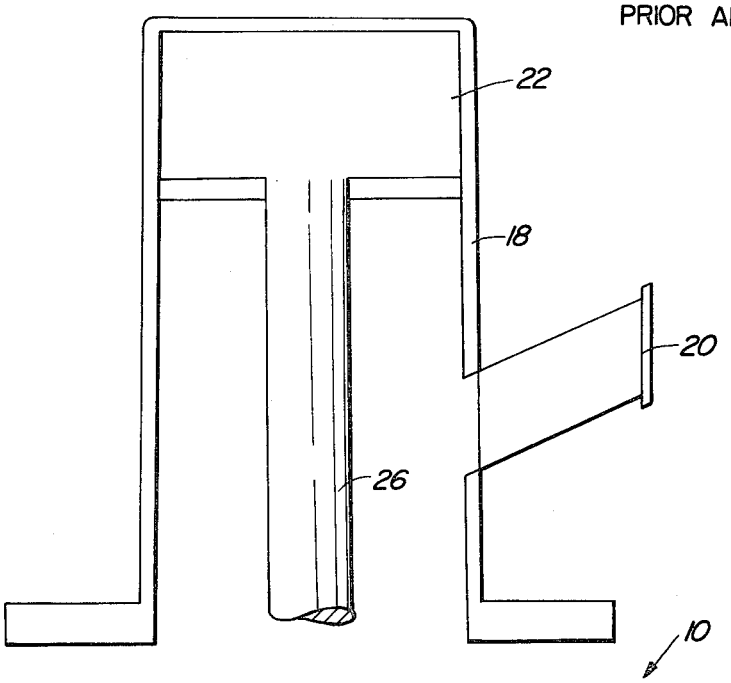
FIG-2 PRIOR ART
FIG. 2 is an enlarged section view of a prior art diffuser pump taken on line 2—2 of FIG. 3 and is labeled "PRIOR ART"
Figure 2:
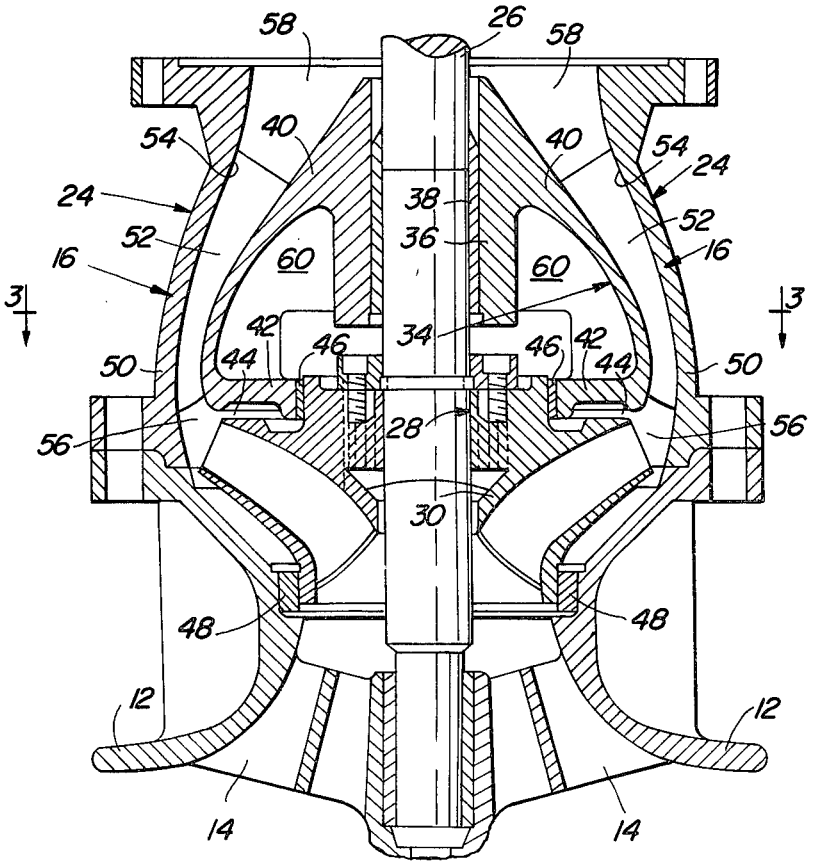
FIG-2 PRIOR ART

FIGS. 2 and 3 illustrate a portion of a prior art pump 10 comprising, from top to bottom, an intake casting 12 having an intake port 14, one or more bowl castings 16 (only one being illustrated), a discharge casting 18, having a discharge port 20, and a motor 22. The castings are interconnected, generally by bolts and the like, to form the pump assembly 24. A shaft 26 connected to the motor 22 provides the power to rotate centrifugal impeller means 28, an impeller 30 being associated with each bowl casting 16. Fluid enters the center of the impeller 30 from the intake port 14 and is ultimately discharged from the discharge port 20. The impellar 30 is so constructed and arranged to throw the fluid outwardly into the bowl casting The bowl casting 16 comprises an acorn 34 having a sleeve portion 36 surrounding the shaft 26 with a sleeve bearing 38 therebetween, a conical portion 40 connected to the sleeve portion 36, and an annular wall portion 42 connected to the conical portion 40. The wall portion 42 defines in part an impeller chamber 44 and also supports a wear ring 46 for the impeller 30. The remainder of the impeller chamber is defined by a portion of the intake casting 12 which also supports a wear ring 48 for the impeller. The conical portion 40 of the casting 16 is connected to the outer wall 50 of the casting 16 by a plurality of vanes 52 to thus define a plurality of fluid passageways 54. The passageways 54 intersect, at their ends, annular zones 56 and 58. The impeller 30 discharges fluid in the zone 56. The zone 58 is connected to the intake of the next succeeding impeller or to the discharge casting. The outer wall 50 defines in part the outer wall of the pump assembly 24. Ribs 60 are also provided to connect and reinforce portions 36, 40 and 42 of the acorn 34. Each of the castings 16 is provided with a flange having a plurality of bolt holes therethrough, so that the castings can be bolted together to form the composite structure. As will be noted in the prior art pump, the outer configuration of the pump is generally circular and the bowl casting adds considerable mass to the pump assembly.

Figure 5:
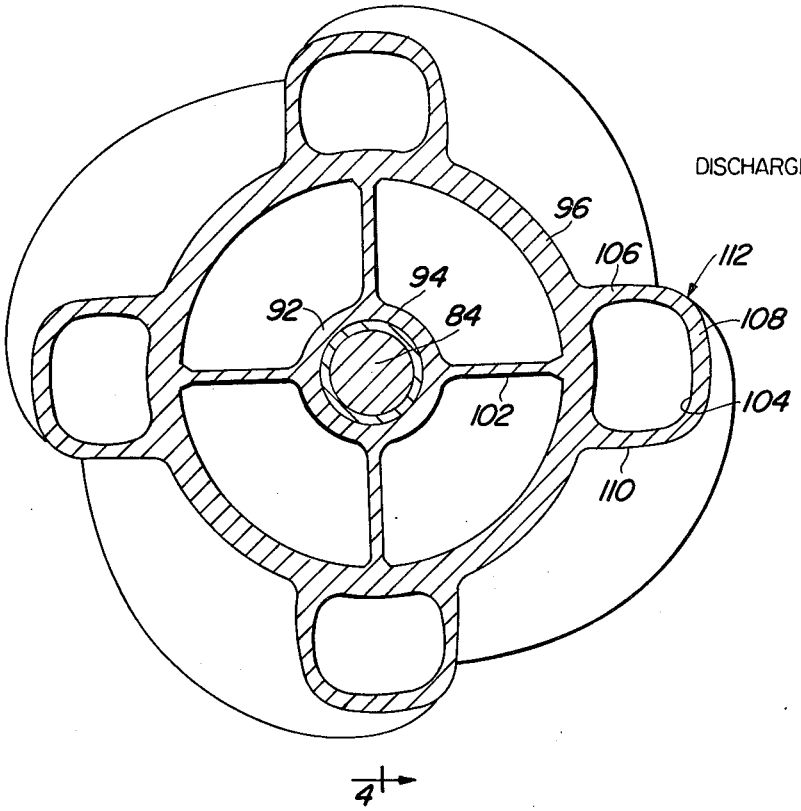
FIG. 5 is a sectional view taken on line 5—5 of FIG. 4.
Figure 4:
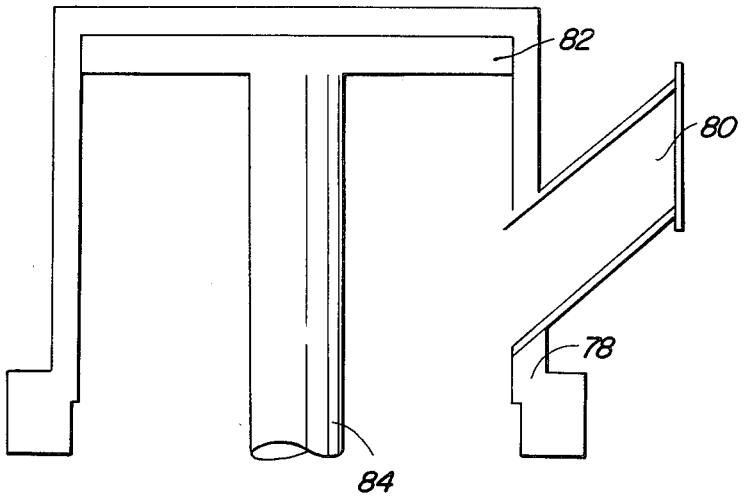
FIG. 4 is an enlarged sectional view of a pump constructed according to ths invention taken on line 4—4 of FIG. 5.
Figure 4:
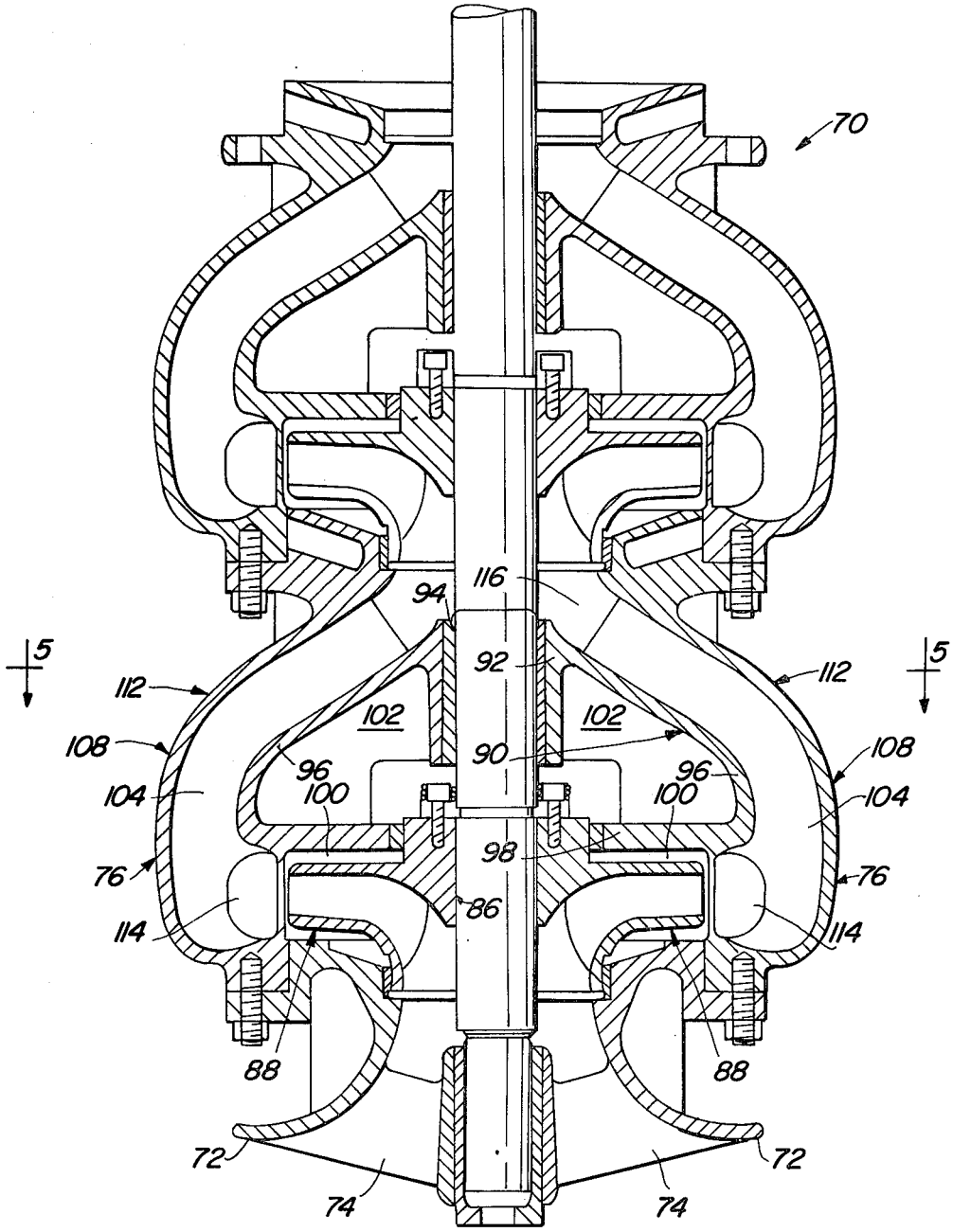

The pump 70 of the present invention is illustrated in FIGS. 4 and 5, and like the prior art pump 10, comprises an intake casting 72 with an intake port 74, and one or more bowl castings 76, a discharge casting 78 having a discharge port 80, and an electric motor or other prime mover 82, interconnected as illustrated. A shaft 84 connected to the motor 82 drives impeller means 86 comprising a centrifugal impeller 88 in each bowl casting 76. The differences between the prior art pump 10 of FIGS. 2 and 3 and the pump 70 of this invention, as illustrated in FIGS. 4 and 5, is in the construction and configuration of the bowl castings 76.

The bowl casting 76 comprises an acorn 90 having a sleeve portion 92 surrounding the shaft 84 with a sleeve bearing 94 therebetween, a conical portion 96, and an annular wall portion 98, the wall portion defining in part an impeller chamber 100. Ribs 102 connect the portions 92, 96 and 98 of the casting 76. A plurality of individual fluid passages 104 are each defined by walls 106, 108 and 110 (see FIG. 5), the walls 106 and 110 extending radially outwardly from the conical portion 96 of the acorn 90. Passages 104 can be any generally square, rectangular, trapezoidal, oval or circular shape. Two or more passages 104 can be used without departing from the spirit of the invention. The outside of the pump assembly, generally identified as 112, is defined in part by the conical portion 96 of the acorn 90 and the passage walls 106, 108 and 110. The passages 104 are connected to annular chambers 114 and 116, defining, respectively, an intake to the passages 104 from the impeller 88 and a discharge from the passages 104. The discharge from the passages 104 serves as an inlet to the next succeeding impeller 88, or to the discharge port 80. As in the usual pumps, the various parts of the pump are bolted together.

The invention herein described relates to a single suction vertical pump assembly that permits radial diffusers (fluid expansion and velocity-to-pressure conversion passageways extending in a fully tangential and radial direction, not axial, outward from the impeller) which is lighter in weight than conventional pumps. This is accomplished by individually enclosing each fluid passage in the crossover region with an individual covering or wall which is integrally cast on to the acorn.

The passages are not constrained to follow a hydraulic path dictated by an outer circular shaped boundary. By eliminating outer circular boundary design constraint, the fluid passages can be shaped to suit an optimum crossover to the next stage or discharge. Also, because the effective pressure boundary size is reduced, wall thicknesses, and thus weight, are reduced. Two or more diffuser-crossovers are used. The pump specific speed can be altered by simply changing the number of individual passageways on the bowl casting.

We claim:

1. A centrifugal pump assembly comprising:

a rotatably driven shaft;

means to drive said shaft;

a centrifugal impeller connected to said shaft for rotation therewith;

an inlet casting having a generally centrally located inlet passage communicating with said impeller;

a discharge casting having a discharge outlet communicating with said impeller;

a bowl casting surrounding said shaft and connected respectively to said inlet and said discharge castings;

an acorn formed integrally as part of said bowl casting; and at least two integral and individual fluid diffuser passages each with walls joined to said acorn defining the exterior of said bowl casting and the exterior of said pump assembly;

said acorn also defining with said fluid passages walls the exterior of said bowl casting and the exterior of said pump assembly;

said passages permitting fluid flow from said impeller to said discharge outlet, the number of said passages being selected to provide the desired specific speed of said pump assembly.

2. A centrifugal pump assembly as recited in claim 1, in which said passages are generally spirally configured.

3. A centrifugal pump assembly comprising:

a rotatably driven shaft;

means to drive said shaft;

a centrifugal impeller connected to said shaft for rotation therewith;

an inlet casting having an inlet passage communicating with said impeller;

a discharge casting having an outlet communicating with said impeller;

a bowl casting integrally formed with an acorn and surrounding said shaft;

said bowl casting having at least two individual fluid passages each with walls thereof defining the exterior of the bowl and said assembly, said passages permitting the flow of fluid from said impeller to said outlet.

* * * * *

UNITED STATES PATENT AND TRADEMARK OFFICE

CERTIFICATE OF CORRECTION

PATENT NO. : 4,462,751

DATED : July 31, 1984

INVENTOR(S) : Wallace L. Smith and Randal S. Ferman

It is certified that error appears in the above—identified patent and that said Letters Patent is hereby corrected as shown below:

Column 5, delete claim 3, in it entirety.

On the title page, "3 Claims, 5 Drawing Figures" should read

-- 2 Claims, 5 Drawing Figures --.

Signed and Sealed this

*First* Day of *January 1985*

[SEAL]

*Attest:*

*Attesting Officer*

GERALD J. MOSSINGHOFF

*Commissioner of Patents and Trademarks*